US009389543B2

(12) United States Patent
Okabayashi

(10) Patent No.: US 9,389,543 B2
(45) Date of Patent: Jul. 12, 2016

(54) IMAGE FORMING APPARATUS HAVING TRANSFER AND FIXING PARTS WITH DIFFERENT WIDTHS

(71) Applicant: FUJI XEROX CO., LTD., Tokyo (JP)

(72) Inventor: Yasuto Okabayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/700,725

(22) Filed: Apr. 30, 2015

(65) Prior Publication Data

US 2016/0170334 A1 Jun. 16, 2016

(30) Foreign Application Priority Data

Dec. 11, 2014 (JP) ..... 2014-250704

(51) Int. Cl.
*G03G 16/00* (2006.01)
*G03G 15/16* (2006.01)
*G03G 15/20* (2006.01)

(52) U.S. Cl.
CPC ..... *G03G 15/1605* (2013.01); *G03G 15/2053* (2013.01)

(58) Field of Classification Search
CPC ..... G03G 15/0808; G03G 15/2053; G03G 15/1605
USPC ..... 399/279, 302, 330
See application file for complete search history.

(56) References Cited

U.S. PATENT DOCUMENTS

2011/0076053 A1* 3/2011 Kadota ..... 399/101
2013/0236208 A1* 9/2013 Komatsu ..... 399/101

FOREIGN PATENT DOCUMENTS

JP 60051864 A * 3/1985
JP 01013574 A * 1/1989
JP 2002108076 A * 4/2002
JP 2004118074 A * 4/2004
JP 2010-107623 A 5/2010
JP 2012234031 A * 11/2012

* cited by examiner

*Primary Examiner* — Robert Beatty
(74) *Attorney, Agent, or Firm* — Oliff PLC

(57) ABSTRACT

An image forming apparatus includes a toner-image forming part that forms a toner image; a first transfer part that transfers the toner image to an intermediate transfer body; a second transfer part that contacts a back surface of a recording medium to transfer the toner image on the intermediate transfer body to the recording medium; and a fixing part including a fixing member that is heated to fix the toner image to the recording medium and a pressure member that transports the recording medium in cooperation with the fixing member by pinching the recording medium therebetween. The maximum width, in the axial direction, of the second transfer part in which it is capable of transferring the toner image to the recording medium is larger than the maximum width, in the axial direction, of the fixing member in which it is capable of fixing the toner image to the recording medium.

4 Claims, 8 Drawing Sheets

IMAGE FORMING APPARATUS HAVING TRANSFER AND FIXING PARTS WITH DIFFERENT WIDTHS

CROSS-REFERENCE TO RELATED APPLICATIONS

This application is based on and claims priority under 35 USC 119 from Japanese Patent Application No. 2014-250704 filed Dec. 11, 2014.

BACKGROUND

Technical Field

The present invention relates to an image forming apparatus.

SUMMARY

According to an aspect of the invention, there is provided an image forming apparatus including a toner-image forming part that forms a toner image; a first transfer part that transfers the toner image formed by the toner-image forming part to an intermediate transfer body; a second transfer part that contacts a back surface of a recording medium to transfer the toner image on the intermediate transfer body to the recording medium; and a fixing part including a fixing member that is heated to fix the toner image to the recording medium and a pressure member that transports the recording medium in cooperation with the fixing member by pinching the recording medium therebetween. The maximum width, in the axial direction, of the second transfer part in which it is capable of transferring the toner image to the recording medium is larger than the maximum width, in the axial direction, of the fixing member in which it is capable of fixing the toner image to the recording medium.

BRIEF DESCRIPTION OF THE DRAWINGS

Exemplary embodiment of the present invention will be described in detail based on the following figures, wherein.

DETAILED DESCRIPTION

Figure 1:
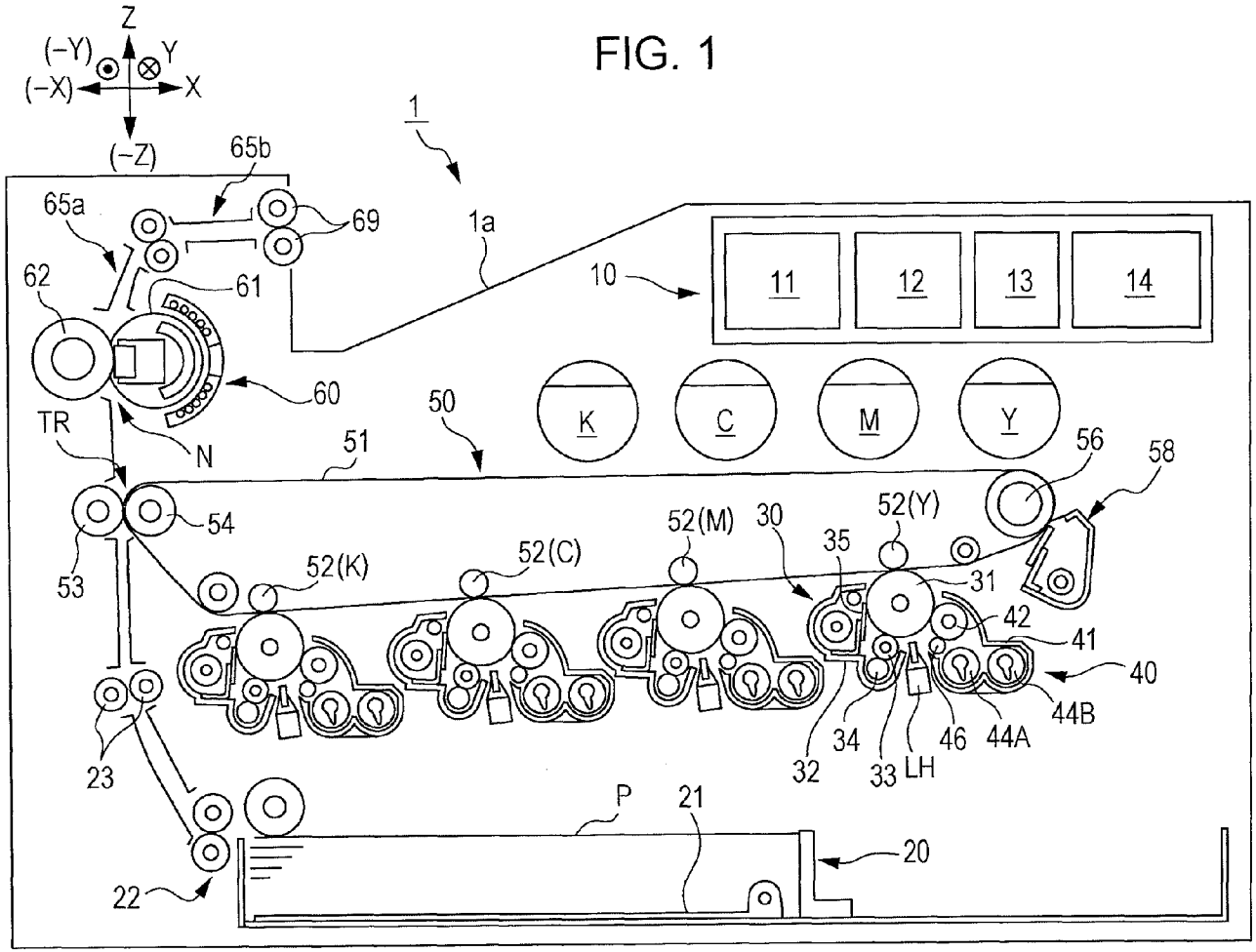
FIG. 1 is a schematic sectional view showing the internal configuration of an image forming apparatus.

Now, the present invention will be described in detail below with reference to the drawings and by using an exemplary embodiment and a specific example. Note that the present invention is not limited to such an exemplary embodiment and a specific example.

Furthermore, it should be noted that the drawings are schematic, and the dimensional proportions are different from those in actuality. For the ease of understanding, illustration of components other than those necessary for explanation is omitted.

Note that, for the ease of understanding the following description, a front-rear direction, a left-right direction, and a top-bottom direction will be indicated as an X-axis direction, a Y-axis direction, and a Z-axis direction, respectively, in the drawings.

1. Overall Configuration and Operation of Image Forming Apparatus

FIG. 1 is a schematic sectional view showing the internal configuration of an image forming apparatus 1 according to this exemplary embodiment.

The overall configuration and operation of the image forming apparatus 1 will be described with reference to the drawings.

The image forming apparatus 1 includes a control unit 10, a paper feed device 20, photoconductor units 30, developing devices 40, a transfer device 50, and a fixing device 60. The image forming apparatus 1 has an output tray 1*a* in the top surface (Z direction) thereof, onto which sheets having images recorded thereon are output and stored.

The control unit 10 includes a controller 11 that controls the operation of the image forming apparatus 1, an image processing portion 12 that is controlled by the controller 11, a power supply unit 13, etc. The power supply unit 13 applies voltages to charging rollers 33, developing rollers 42, first transfer rollers 52, a second transfer roller 53, etc. described below.

The image processing portion 12 converts print information inputted from an external information transmitting apparatus (e.g., a personal computer, etc.) into image information for forming a latent image and then outputs a driving signal to exposure devices LH at predetermined timing. The exposure devices LH according to this exemplary embodiment are formed of light emitting diode (LED) heads in which LEDs are linearly arranged.

The image forming apparatus 1 has a paper feed device 20 at the bottom. The paper feed device 20 has a paper tray 21 that carries multiple sheets P, serving as recording media. The sheets P that are stored on the paper tray 21 with their widthwise and lengthwise positions being regulated by a regulating plate (not shown) are drawn out toward the front side (−X direction) one by one from the top by a sheet drawing portion 22 and are transported to the nip of a registration roller pair 23.

Beside A3 sheets P (width: 297 mm×length: 420 mm), which is usually the maximum size, the paper tray 21 is capable of holding SRA3 sheets P (width: 320 mm×length: 450 mm) and A3 full-bleed sheets P (width: 330 mm×length: 488 mm), which are larger than the A3 sheets P.

The photoconductor units 30 are provided parallel to one another above (on the Z direction side of) the paper feed device 20 and each include a photoconductor drum 31, serving as a rotating toner image carrier. The charging roller 33, the exposure device LH, the developing device 40, the first transfer roller 52, and a cleaning blade 35 are arranged in this order in the rotation direction of the photoconductor drum 31. A cleaning roller 34 for cleaning the surface of the charging roller 33 is provided in contact with the charging roller 33.

The developing device 40 includes a developer housing 41 that accommodates developer therein. The developer housing 41 accommodates the developing roller 42 that is disposed opposite the photoconductor drum 31 and serves as a developing part, and a pair of augers 44A and 44B that are provided on the lower rear side of the developing roller 42 and transport, while stirring, the developer toward the developing roller 42. A layer regulating member 46 that regulates the thickness of a developer layer is provided near the developing roller 42.

The respective developing devices 40 have substantially the same configuration except for the developers contained in the developer housings 41 and each form corresponding one of yellow (Y), magenta (M), cyan (C), and black (K) toner images.

The surface of the rotating photoconductor drum 31 is charged by the charging roller 33, and an electrostatic latent image is formed thereon by latent-image-forming light emitted from the exposure device LH. The electrostatic latent image formed on the photoconductor drum 31 is developed into a toner image by the developing roller 42.

The transfer device 50 includes an intermediate transfer belt 51, serving as an intermediate transfer body, to which toner images of the respective colors formed on the photoconductor drums 31 of the photoconductor units 30 are multilayer-transferred; the first transfer rollers 52, serving as a first transfer part, that sequentially transfer (first transfer) the toner images of the respective colors formed on the photoconductor units 30 to the intermediate transfer belt 51; and the second transfer roller 53, serving as a second transfer part, that transfers (second transfers) the toner images of the respective colors transferred in a superimposed manner onto the intermediate transfer belt 51 to a sheet P, serving as a recording medium.

The toner images of the respective colors that are formed on the photoconductor drums 31 of the photoconductor units 30 are sequentially electrostatically transferred (first transferred) to the intermediate transfer belt 51 by the first transfer rollers 52 that receive a predetermined transfer voltage from the power supply unit 13 or the like controlled by the controller 11. Thus, a superimposed toner image, in which the respective color toner images are superimposed, is formed.

As the intermediate transfer belt 51 moves, the superimposed toner image on the intermediate transfer belt 51 is transported to a region (second transfer portion TR) where the second transfer roller 53 is disposed. At the same time when the superimposed toner image is transported to the second transfer portion TR, the paper feed device 20 feeds a sheet P to the second transfer portion TR. Then, a predetermined transfer voltage is applied to the second transfer roller 53 by the power supply unit 13, which is controlled by the controller 11, to transfer the multilayer toner image on the intermediate transfer belt 51 to the sheet P that is fed by the registration roller pair 23 and is guided by the transport guide.

The residual toner on the surfaces of the photoconductor drums 31 is removed by the cleaning blades 35 and is recovered in waste toner containers (not shown). The surfaces of the photoconductor drums 31 are charged again by the charging rollers 33. The residues that were not removed by the cleaning blade 35 and adhered to the charging rollers 33 are caught and accumulated by the surfaces of the cleaning rollers 34 that are rotated in contact with the charging rollers 33.

The fixing device 60 includes an endless fixing belt 61 that is rotated in one direction, and a pressure roller 62 that is in contact with the circumferential surface of the fixing belt 61 and is rotated in one direction. A region where the fixing belt 61 and the pressure roller 62 are urged against each other serves as a fixing nip portion N (fixing region).

The sheet P having a toner image transferred, but not yet fixed, thereto by the transfer device 50 is transported to the fixing device 60 via the transport guide. The sheet P transported to the fixing device 60 is pressed and heated between the fixing belt 61 and the pressure roller 62, which form a pair, and the toner image on the sheet P is fixed. The sheet P with the toner image fixed thereto is guided by the transport guide and is output from the output roller pair 69 onto the output tray 1*a* provided on the top surface of the image forming apparatus 1.

As has been described above, because the image forming apparatus 1 has a C-path configuration, in which the sheet transport path extending from the paper feed device 20 via the second transfer roller 53 to the output roller pair 69 forms a C shape, the length of the sheet transport path is minimum. Thus, it is possible to minimize the first printout time (FPOT), which is the time taken to output the first sheet P after printing is started.

2. Configuration of Photoconductor Unit

Figure 2:
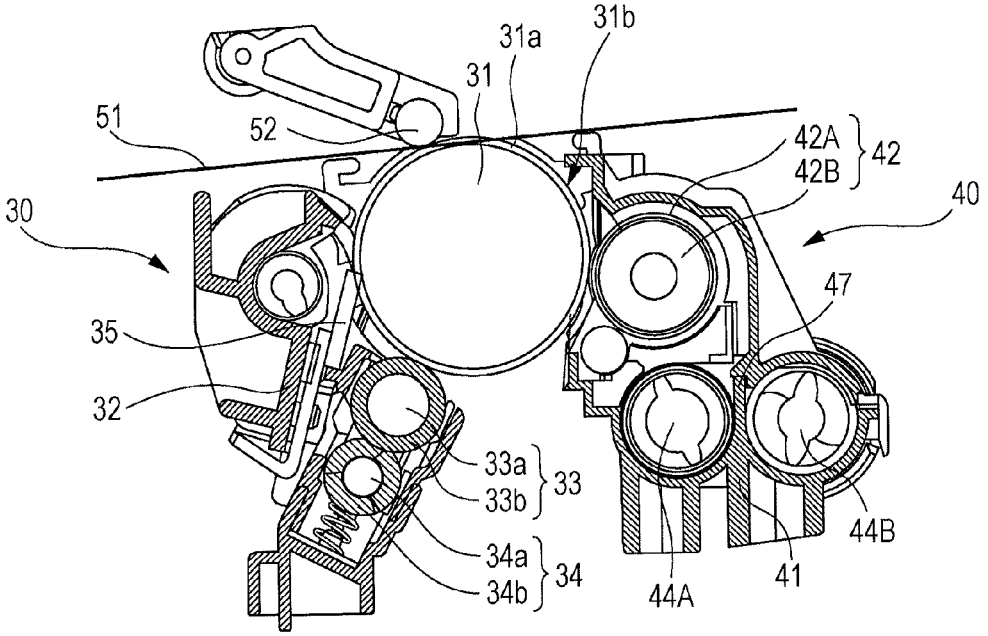
FIG. 2 is a schematic sectional view of a photoconductor unit and a developing device.
Figure 3A:
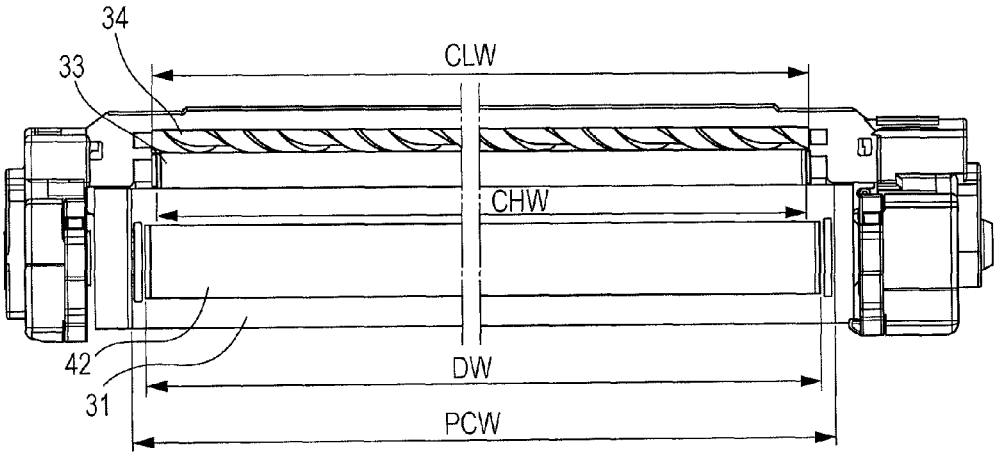
FIG. 3A is a front development diagram showing the relationship among the lengths, in the axial direction, of the principal parts of the photoconductor unit, including a developing roller.
Figure 3B:
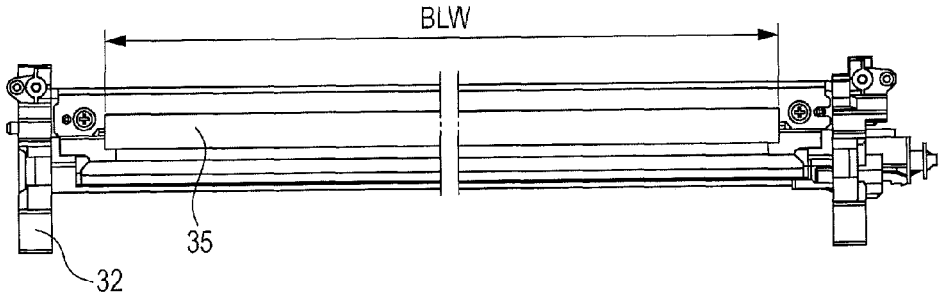
FIG. 3B is a front view showing the inside of the photoconductor unit.

FIG. 2 is a schematic sectional view of the photoconductor unit 30 and the developing device 40, serving as a toner-image forming part, FIG. 3A is a front development diagram showing the relationship among the lengths in the axial direction of the principal parts of the photoconductor unit 30, including the developing roller 42, and FIG. 3B is a front view showing the inside of the photoconductor unit 30.

The photoconductor unit 30 includes the photoconductor drum 31, serving as a toner image carrier; the unit housing 32, serving as a support member; the charging roller 33, serving as a charging member; the cleaning roller 34, serving as a cleaning member; and the cleaning blade 35. The photoconductor unit 30 is removably attached to the image forming apparatus 1.

The unit housing 32 supports the photoconductor drum 31 in a rotatable manner and supports the cleaning blade 35 for cleaning the surface of the photoconductor drum 31 in a fixed manner. Furthermore, the unit housing 32 temporarily stores the toner, paper dust, etc., that are removed from the surface of the photoconductor drum 31 by the cleaning blade 35.

The photoconductor drum 31 includes a drum-shaped conductive support 31*a* and a photosensitive layer 31*b* provided thereon, the photosensitive layer 31*b* including an undercoat layer, a charge generating layer, a charge transport layer, and a protection layer that are stacked in this order. Note that the photoconductor drum 31 does not necessarily have an undercoat layer.

The coating width, PCW, of the photosensitive layer 31*b* is 360 mm so as to be compatible with A3 full-bleed sheets P (width: 330 mm).

The charging roller 33 includes a conductive shaft 33*a* and a charging layer 33*b* formed thereon, the charging layer 33*b* including a conductive elastic layer and a surface layer.

The conductive elastic layer constituting the charging layer 33*b* is formed by covering the circumferential surface of the conductive shaft 33*a* with, for example, an elastic material, such as rubber, containing an appropriate amount of conducting material for adjusting the resistance of the conductive elastic layer, such as carbon black or an ion conducting material.

The surface layer constituting the charging layer 33*b* is provided to prevent contamination with a toner component, paper dust, etc. and is formed of a fluorocarbon polymer or silicone polymer, more specifically, fluorocarbon-modified acrylate polymer.

The width, CHW, of the charging layer 33*b* in the axial direction is 340 mm, corresponding to the coating width of the photosensitive layer 31*b* of the photoconductor drum 31 that is compatible with A3 full-bleed sheets P (width: 330 mm).

The cleaning roller 34 is formed of a shaft 34*a*, which is formed of a free-cutting steel, stainless steel, or the like, and a sponge layer 34*b*, which formed of a porous foam and is wound around the shaft 34*a* in a spiral. The sponge layer 34*b* efficiently scrapes off toner external additives and paper dust while being rotated by the charging roller 33.

The width, CLW, of the sponge layer 34*b* in the axial direction is 342 mm, corresponding to the width (340 mm) of the charging layer 33*b* of the charging roller 33 in the axial direction. When the toner external additives and paper dust taken into cells in the sponge layer 34*b* gather together and reach a predetermined size, they are returned from the cleaning roller 34 to the photoconductor drum 31 via the charging roller 33 and are removed and recovered by the cleaning blade 35 for cleaning the photoconductor drum 31.

The cleaning blade 35 is formed of a material having good mechanical properties (i.e., wear resistance, chipping resistance, creep resistance, etc.), such as a urethane rubber, like thermosetting polyurethane rubber, and has a width, BLW, in the axial direction of 347 mm to remove the toner, paper dust, etc. from the surface of the photoconductor drum 31.

3. Configuration of Developing Device

In the developing device 40, the developing roller 42 is supported by side plates of the developer housing 41 so as to be rotatable.

The developer housing 41 includes a developer storage chamber, and transport augers 44A and 44B are supported in the developer storage chamber so as to be rotatable. A partition wall 47 that separates the transport augers 44A and 44B from each other is provided in the middle of the developer storage chamber in sectional view.

The developing roller 42 is disposed opposite the outer circumferential surface of the photoconductor drum 31 through an opening 41C provided in the developer housing 41. Furthermore, the developing roller 42 includes a cylindrical developing sleeve 42A that is supported by the developer housing 41 so as to be rotatable, and a cylindrical magnet 42B that is provided in an inner space of the developing sleeve 42A and is fixed to the developer housing 41.

The developing sleeve 42A is rotated by a rotational driving force supplied from a driving unit (not shown) of a body of the image forming apparatus 1. The developing sleeve 42A holds the developer on the outer circumferential surface thereof by the magnetic force of the magnet 42B and supplies the developer to the electrostatic latent image formed on the photoconductor drum 31 by the rotation of the developing sleeve 42A.

The width, DW, of the developing sleeve 42A in the axial direction is 350 mm so as to be compatible with A3 full-bleed sheets P (width: 330 mm).

4. Configuration of Transfer Device

Figure 4A:
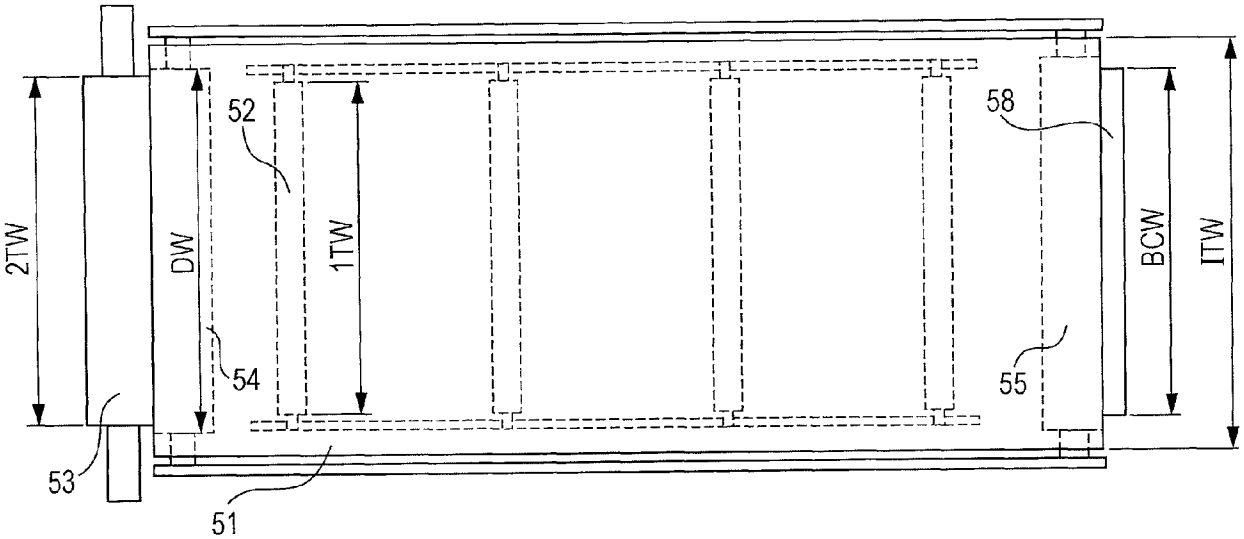
FIG. 4A is a schematic plan view showing the relationship among the widths of the components of a transfer device including a second transfer roller.
Figure 4B:
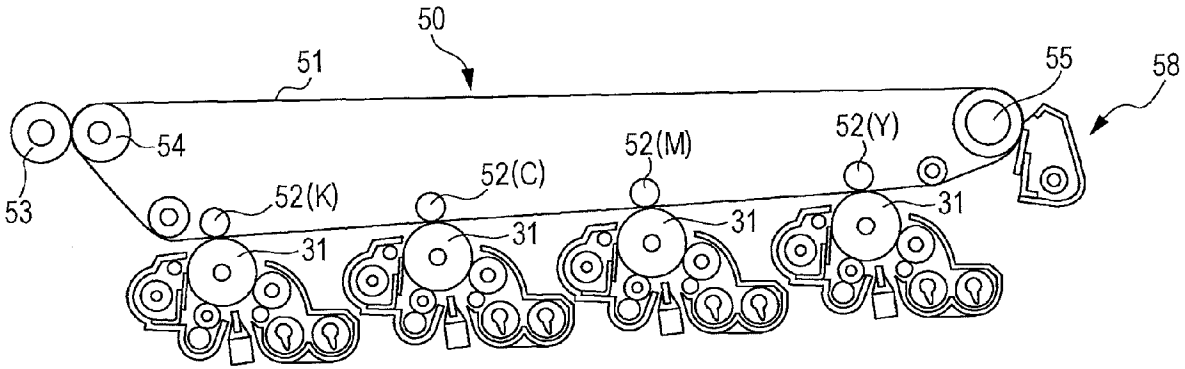
FIG. 4B is a schematic sectional view showing the internal configuration of the photoconductor drums and the transfer device including the second transfer roller.

FIG. 4A is a schematic plan view showing the relationship among the widths of the components of the transfer device 50 including the second transfer roller 53, and FIG. 4B is a schematic sectional view showing the internal configuration of the photoconductor drums 31 and the transfer device 50 including the second transfer roller 53.

As shown in FIGS. 4A and 4B, an intermediate transfer belt unit 500 includes the intermediate transfer belt 51, serving as an endless belt member; the first transfer rollers 52; the driving roller 54; and the support roller 55. These rollers are supported by support members (not shown) at the ends in the rotation shaft direction. The intermediate transfer belt unit 500 also includes an intermediate transfer belt cleaner 58 that removes residual toner, etc. remaining on the intermediate transfer belt 51.

The intermediate transfer belt 51 is a film-like endless belt that is formed of polyimide or polyamide resin containing an appropriate amount of conductive agent, such as carbon black. The intermediate transfer belt 51 has a volume resistivity of 106 to 1014 Ω·cm and has a thickness of, for example, about 0.1 mm.

The width, ITW, of the intermediate transfer belt 51 in the width direction is 363 mm so as to be compatible with A3 full-bleed sheets P (width: 330 mm).

The intermediate transfer belt 51 is stretched between the driving roller 54, which causes the intermediate transfer belt 51 to revolve; and the support roller 55, which supports the intermediate transfer belt 51 extending substantially linearly in a direction in which the photoconductor drums 31 are arranged, applies a predetermined tension to the intermediate transfer belt 51, and prevents meandering of the intermediate transfer belt 51.

The driving roller 54 is formed of, for example, ethylene propylene diene monomer (EPDM) rubber with carbon dispersed therein. The driving roller 54 has a diameter of 28 mm and has an Asker C hardness of, for example, 70 degrees.

The axial size of the driving roller 54, i.e., the width, DW, of a rubber portion thereof that is in contact with the inner surface of the intermediate transfer belt 51 and exerts a frictional force for causing the intermediate transfer belt 51 to revolve, is 345 mm.

The first transfer rollers 52 are arranged opposite the photoconductor drums 31 with the intermediate transfer belt 51 therebetween, and a voltage having an opposite polarity to the toner charge polarity is applied to the first transfer rollers 52. As a result, the toner images on the respective photoconductor drums 31 are sequentially electrostatically attracted to the intermediate transfer belt 51, and a superimposed toner image is formed on the intermediate transfer belt 51.

The first transfer rollers 52 have a cylindrical shape with an outside diameter of, for example, 8 mm and are formed of a known metal, such as stainless steel (SUS), iron, or aluminium. The metal surface is desirably plated with nickel, copper, or chromium.

Alternatively, the first transfer rollers 52 may be elastic rollers each formed of, for example, a stainless steel conductive core and a conductive foam elastic rubber member wound around the outer circumference thereof, the rubber member having an Asker C hardness of 30 to 50 degrees. The resistance is adjusted by mixing an ion conducting material into the conductive foam elastic member. The diameter of the first transfer rollers 52 covered with the conductive foam elastic members is, for example, 16 mm to 25 mm.

The width, 1TW, of the first transfer rollers 52 in the axial direction is 332 mm to contact the intermediate transfer belt 51 from inside and transfer toner images formed on the photoconductor drums 31 to the surface of the intermediate transfer belt 51.

The second transfer roller 53 is formed of semiconducting rubber having a volume resistivity of, for example, 106 to 1010 Ω·cm and is disposed opposite the driving roller 54 with the intermediate transfer belt 51 therebetween. The second transfer roller 53 and the driving roller 54 form the second transfer portion TR, where the toner image supported on the intermediate transfer belt 51 is second transferred to the sheet P transported from the paper feed device 20.

The width, 2TW, of the second transfer roller 53 in the width direction is 340 mm to maintain uniform pressure distribution on A3 full-bleed sheets P (width: 330 mm) and to suppress uneven density of the images transferred to the sheets P.

Herein, the maximum width (effective transfer width), in the axial direction, of the second transfer roller 53 in which it is capable of transferring a toner image to a recording medium is 327 mm. Furthermore, the contact width, in the axial direction, between the second transfer roller 53 and the intermediate transfer belt 51 is 340 mm.

The intermediate transfer belt cleaner 58 is made of a material having good mechanical properties (i.e., wear resistance, chipping resistance, creep resistance, etc.), such as a urethane rubber, like thermosetting polyurethane rubber, or a thin stainless steel plate (scraper). The width, BCW, of the intermediate transfer belt cleaner 58 in the axial direction is 339 mm to scrape off toner, paper dust, etc. from the surface of the intermediate transfer belt 51.

5. Configuration of Fixing Device

Figure 5:
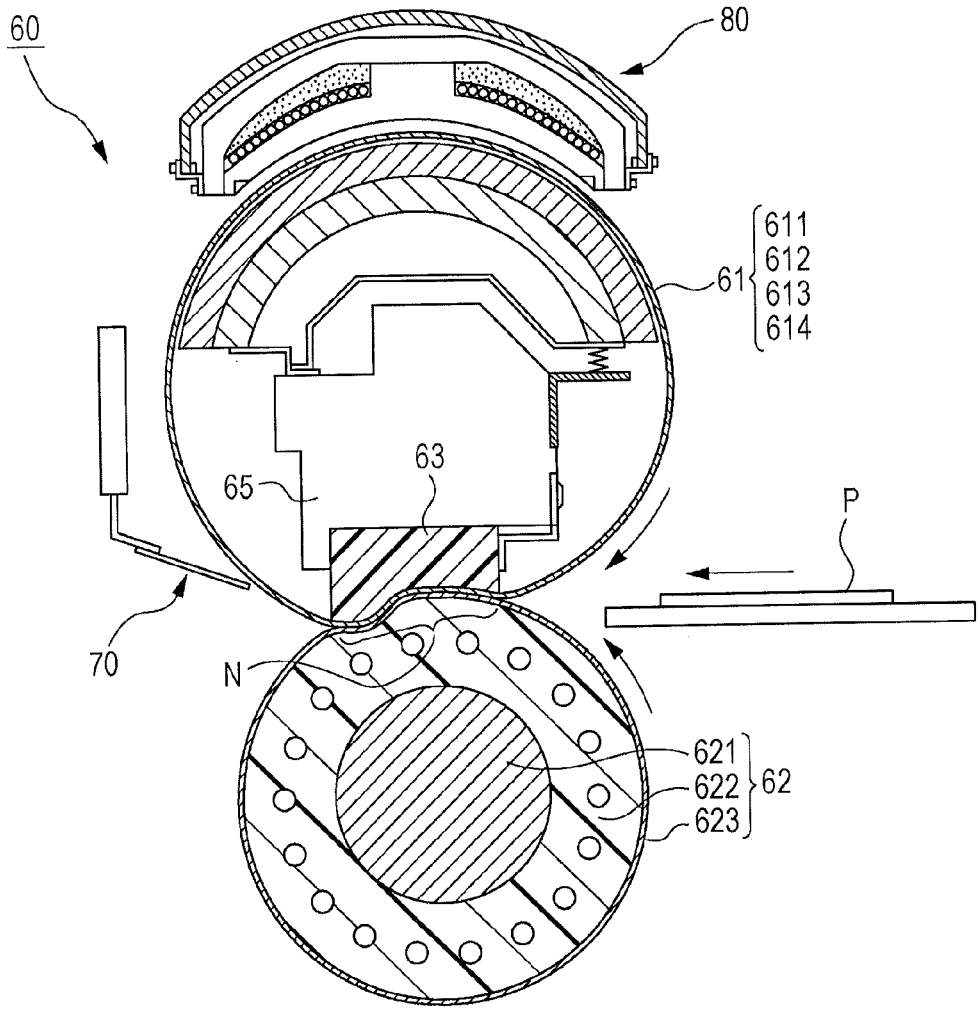
FIG. 5 is a schematic sectional view of a fixing device.
Figure 6:
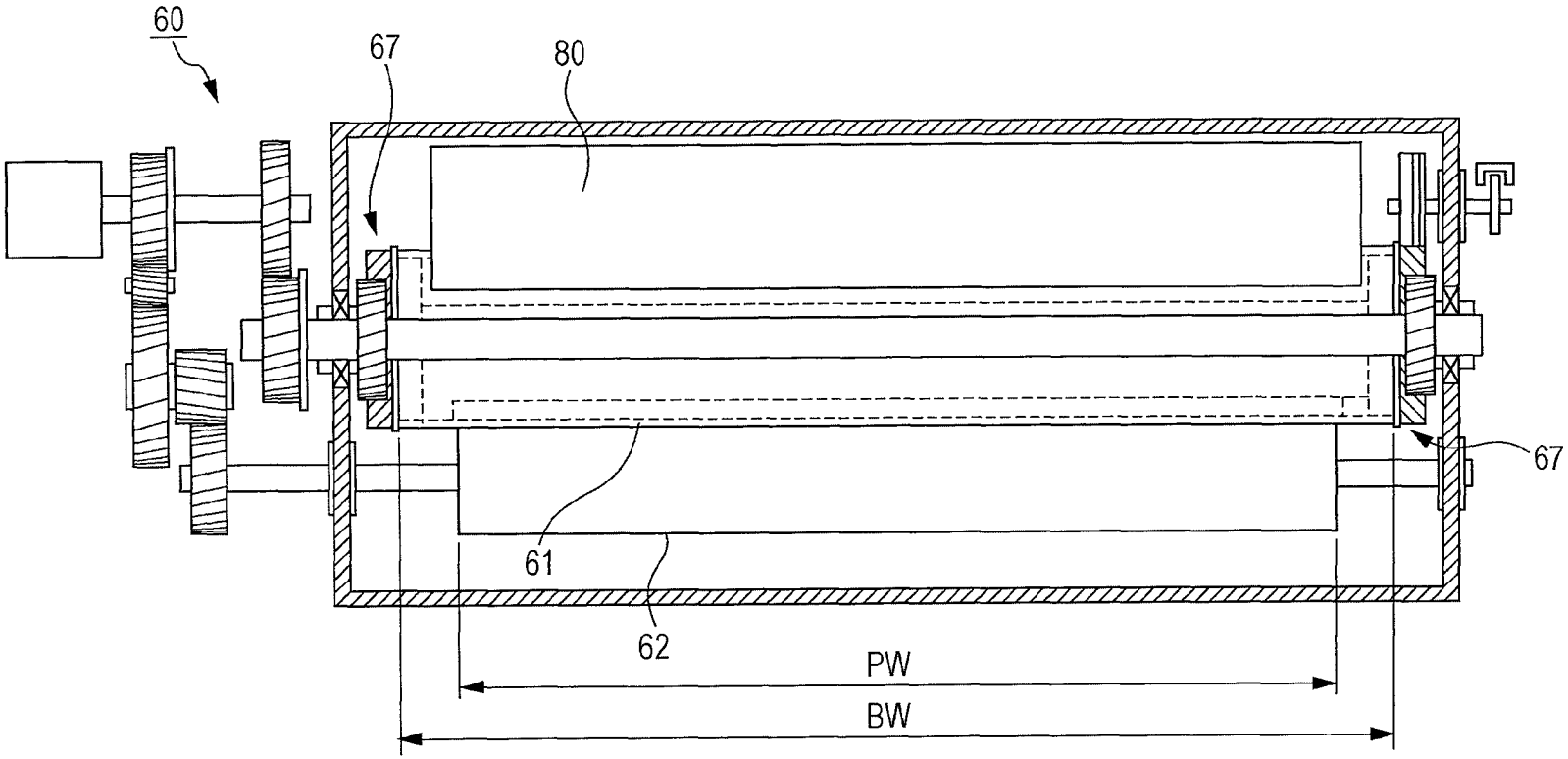
FIG. 6 is a schematic front view of the fixing device, as viewed from a sheet feeding side.

FIG. 5 is a schematic sectional view of the fixing device 60, and FIG. 6 is a schematic front view of the fixing device 60, as viewed from the sheet feeding side.

The fixing device 60 includes an induction heating (IH) heater 80, serving as an example of a magnetic-field generating member; the fixing belt 61, serving as an example of a fixing member, that is heated by the IH heater 80 through electromagnetic induction and fixes a toner image; and the pressure roller 62, serving as an example of a pressure member, that is disposed opposite the fixing belt 61.

On the inner side of the fixing belt 61 are provided a pressure pad 63 that is pressed by the pressure roller 62 with the fixing belt 61 therebetween, forming a fixing nip portion N; a holder 65, serving as an example of a support member, that supports the pressure pad 63 or the like; and a heat conducting portion 64 that generates heat by being electromagnetically induced due to an alternating magnetic field generated by the IH heater 80.

Driving force transmitting members 67 that transmit a rotational driving force for rotating the fixing belt 61 are provided at both ends of the fixing belt 61.

Furthermore, a separation support member 70 that supports separation of the sheet P from the fixing belt 61 is provided on the downstream side, in the sheet transport direction, of the fixing nip portion N between the fixing belt 61 and the pressure roller 62.

The fixing belt 61 is formed of an endless belt member having the initial shape of a cylinder with a diameter of, for example, 20 mm to 50 mm and a width, BW, in the axial direction of 369 mm. Furthermore, the fixing belt 61 has a multilayer structure including a base layer 611, a conductive heat-generating layer 612 formed on the base layer 611, an elastic layer 613 that improves the toner-image fixing characteristics, and a surface releasing layer 614 formed on the top.

The base layer 611 supports the thin conductive heat-generating layer 612 and is formed of a heatproof sheet member that ensures the mechanical strength of the overall fixing belt 61. Examples of the material of the base layer 611 include non-magnetic metal, such as non-magnetic stainless steel, having a thickness of, for example, 30 μm to 200 μm, more preferably, 50 μm to 150 μm, and resin, such as polyimide resin, having a thickness of 50 μm to 200 μm.

The pressure roller 62 includes a cylindrical core 621 that is formed of, for example, metal; a heatproof elastic layer 622 (formed of, for example, silicone rubber or fluorocarbon rubber) that is formed on the outer circumferential surface of the core 621; and, if necessary, a releasing layer 623 that is formed of heatproof resin, such as PFA, or heatproof rubber.

The pressure roller 62 has a width, PW, in the axial direction of 332 mm to apply sufficient pressure to SRA3 sheets P (width: 320 mm), while suppressing heat absorption from the heated fixing belt 61 to ensure high energy efficiency.

Accordingly, the contact width (maximum contact width), in the axial direction, between the pressure roller 62 and an SRA3 sheet P, which is the largest recording medium, is 320 mm. Furthermore, the maximum width (effective fixing width), in the axial direction, of the fixing member in which it is capable of fixing a toner image to a recording medium is 326 mm. Furthermore, the contact width, in the axial direction, between the pressure roller 62 and the fixing belt 61 is 332 mm.

The pressure pad 63 is disposed so as to be pressed by the pressure roller 62 with the fixing belt 61 therebetween and forms the fixing nip portion N between the pressure pad 63 and the pressure roller 62. Thus, the pressure pad 63 has a width in the axial direction of 355 mm, which is sufficiently larger than the length of the pressure roller 62 in the width direction.

The pressure pad 63 may be made of any material, as long as the amount of deformation thereof combined with the holder 65, when pressed by the pressure roller 62, is an allowable value or less, more specifically, 0.5 mm or less. Examples of such a material include elastic material, such as silicone rubber, fluorocarbon rubber, etc. and heatproof resin, such as glass fiber reinforced polyphenylene sulfide (PPS), phenol, polyimide, liquid crystal polymer, etc.

Exemplary Embodiment

Figure 7:
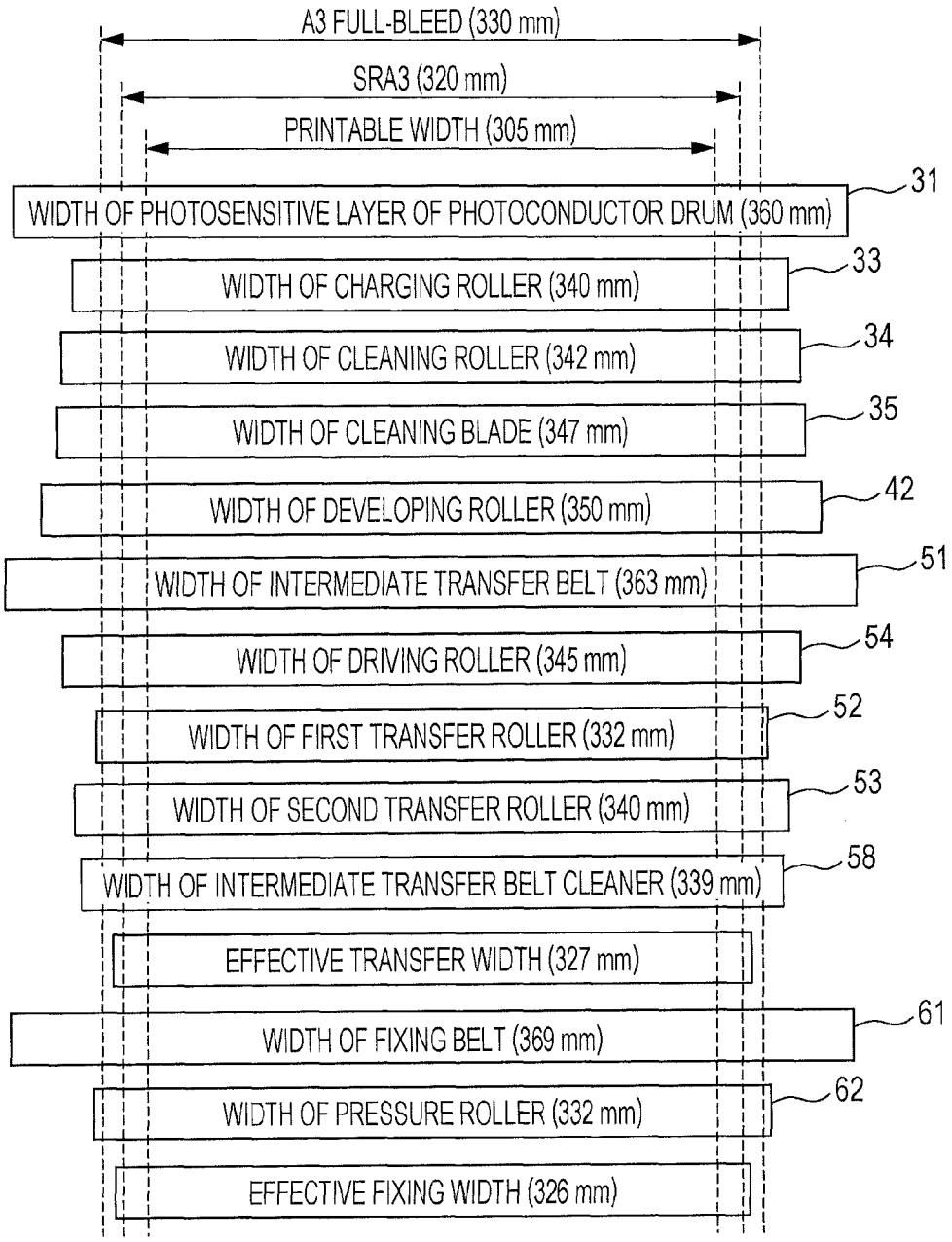
FIG. 7 shows the relationship among the lengths, in the axial direction, of the respective components of the image forming apparatus.
Figure 8A:
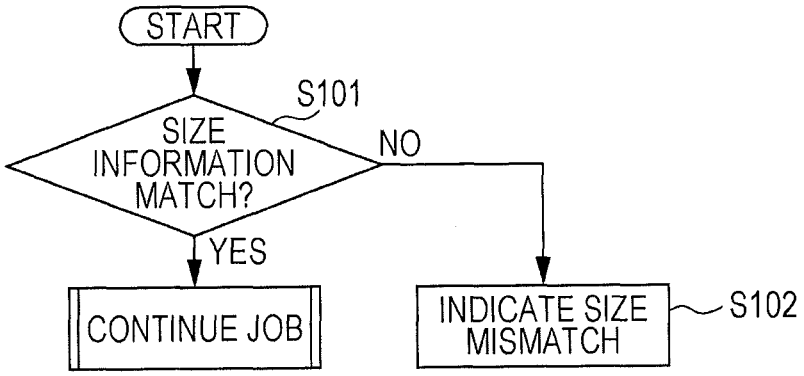
FIGS. 8A and 8B are flowcharts showing the flow of sheet detection when the maximum paper size is SRA3.
Figure 8B:
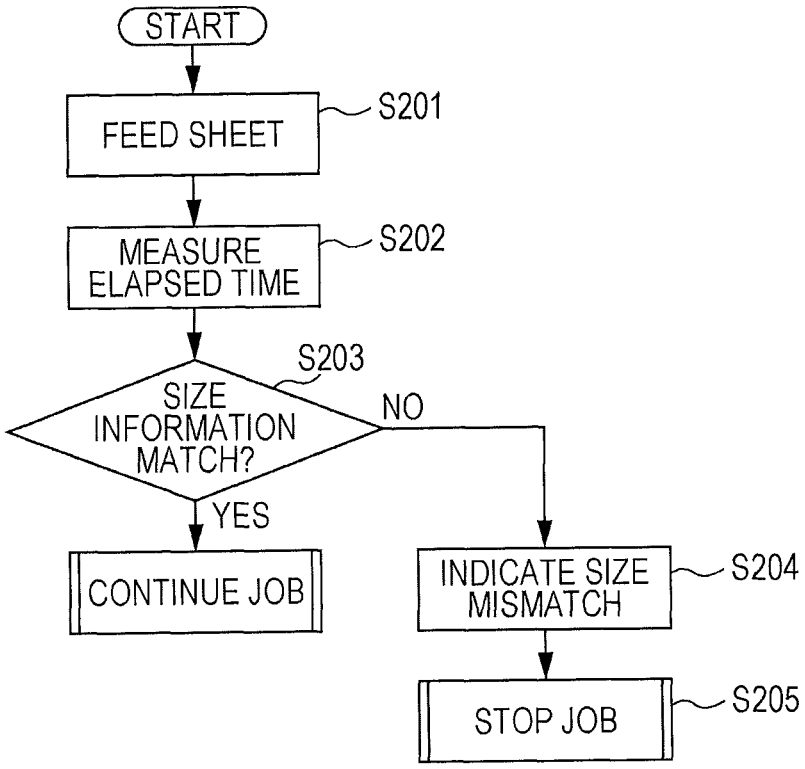

FIG. 7 shows the relationship among the lengths, in the axial direction, of the respective components of the image forming apparatus 1, and FIG. 8 is a flowchart showing the flow of a sheet detecting process when the maximum paper size is SRA3.

As shown in FIG. 7, in this exemplary embodiment, the relationship between the widths, in the axial direction, of the second transfer roller 53 and pressure roller 62 is set as follows: the printable width: 305 mm<the maximum sheet width (SRA3): 320 mm<effective fixing width: 326 mm<effective transfer width: 327 mm<the width, PW, of the pressure roller 62 in the axial direction: 332 mm<the width, 2TW, of the second transfer roller 53 in the axial direction: 340 mm<the width, DW, of the developing rollers 42 in the axial direction: 350 mm<the width, PCW, of the photosensitive layer coating of the photoconductor drum 31: 360 mm.

As above, because the second transfer roller 53 has a width of 340 mm, it is possible to achieve a more uniform nip in the axial direction and suppress uneven density of the transferred image within the printable width (i.e., 305 mm) for SRA3 sheets P.

Furthermore, because the developing rollers 42 has a width, DW, in the axial direction of 350 mm, even when a decrease in density occurs at the ends of the developing rollers 42, the influence of such a decrease in density is suppressed within the printable width, 305 mm.

In this exemplary embodiment, the pressure roller 62 has a width, PW, in the axial direction of 332 mm, which is the minimum size capable of applying sufficient pressure to SRA3 sheets P (width: 320 mm). Hence, the pressure roller 62 has a short warm-up time from power on, while suppressing heat absorption from the heated fixing belt 61 to achieve high energy efficiency.

In the thus-configured image forming apparatus 1 with a maximum paper size of SRA3 (width: 320 mm×length: 450 mm), when an operator sets an A3 full-bleed (width: 330 mm×length: 488 mm) sheet P on the paper tray 21, the following process is performed, because the fixing device is not compatible with A3 full-bleed sheets P.

The paper tray 21 is provided with a regulating plate (not shown) for controlling the widthwise and lengthwise positions of the sheets P set thereon. When the regulating plate of the paper tray 21 is preliminarily fixed to a position corresponding to SRA3 sheets P, it is impossible to set A3 full-bleed sheets P.

When the regulating plate of the paper tray 21 is fixed to a position where it does not limit the position of sheets P, A3 full-bleed sheets P are set thereon.

When a print job is input, the print job processing is started, and whether or not the size information, serving as paper attribute information, for determining the type of the sheet P used in the job matches the size information, serving as paper attribute information of the sheets P stored on the paper tray 21 and assigned to the tray, is determined (S101).

As a result of determination, when the size (SRA3) of the sheet P used in the job does not match the size information of the sheets P stored on the paper tray 21 (S101; No), a size mismatch is detected and such information is indicated (S102), and the image forming apparatus 1 does not start the print job (see FIG. 8A).

When the image forming apparatus 1 does not have a function of detecting the size of the sheets P on the paper tray 21, the print job processing is started upon input of the print job, and a sheet P is drawn by the sheet drawing portion 22 and is fed to the nip portion of the registration roller pair 23 (S201).

The sheet P is temporarily stopped at the registration roller pair 23 and forms a predetermined loop (register loop). In this state, rotation of the registration roller pair 23 is started, and the time taken for the sheet P to pass is measured by a register sensor (not shown) (S202). In this way, the size of the sheet P is detected.

As a result of detection, when the paper size (SRA3) used in the job does not match the size, in the length direction, of the sheet P fed from the paper tray 21 (S203; No), a size mismatch is detected and such information is indicated (S204). Then, the image forming apparatus 1 stops the print job (S205). When only the size, in the length direction, of the sheet P matches the paper size (SRA3) used in the job (S203; Yes), and the print job is continued, the sheet P is transported to the second transfer portion TR, where a toner image is second transferred thereto, and then to the fixing nip portion N (see FIG. 8B).

In the image forming apparatus 1 according to this exemplary embodiment, the second transfer roller 53 has a width, 2TW, of 340 mm, which is compatible with the A3 full-bleed size, and the pressure roller 62 has a width, PW, of 332 mm, which is the minimum size compatible with SRA3 size (width: 320 mm).

When the maximum paper size is A3 full-bleed (width: 330 mm×length: 488 mm), the fixing device needs to be replaced with one compatible with the A3 full-bleed size.

For example, the pressure roller has a width of 342 mm, so that it is capable of applying sufficient pressure to the A3 full-bleed sheet P (width: 330 mm) while reducing heat absorption from the heated fixing belt to achieve high energy efficiency.

The contact width (maximum contact width), in the axial direction, between the pressure roller and an A3 full-bleed sheet P, which is the largest recording medium, is 330 mm. Furthermore, the maximum width (effective fixing width), in the axial direction, of the fixing member in which it is capable of fixing a toner image to the recording medium is 334 mm. Furthermore, the contact width, in the axial direction, between the pressure roller and the fixing belt is 342 mm.

Hence, also in the case where an A3 full-bleed sheet P is fed, unevenness of image density is suppressed, and good fixing characteristics are ensured in a resister section of the A3 full-bleed sheet P.

As has been described above, even when the maximum paper size is SRA3 (width: 320 mm×length: 450 mm), A3 full-bleed sheets P (width: 330 mm×length: 488 mm) may be used by replacing the fixing device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner-image forming part that forms a toner image;

a first transfer part that transfers the toner image formed by the toner-image forming part to an intermediate transfer body;

a second transfer part that contacts a back surface of a recording medium to transfer the toner image on the intermediate transfer body to the recording medium; and a fixing part including a fixing member that is heated to fix the toner image to the recording medium and a pressure member that transports the recording medium in cooperation with the fixing member by pinching the recording medium therebetween, wherein the contact width, in the axial direction, between the second transfer part and the intermediate transfer body is larger than the contact width, in the axial direction, between the pressure member and the fixing member, and wherein the width of the second transfer part is smaller than the width of the fixing member.

2. The image forming apparatus according to claim 1, wherein the maximum width, in the axial direction, of a developing part, which is provided opposite a toner image carrier of the toner-image forming part and develops a toner image on the toner image carrier, in which it is capable of developing the toner image is larger than the maximum width, in the axial direction, of the second transfer part in which it is capable of transferring the toner image to the recording medium.

3. The image forming apparatus according to claim 1, wherein the width, in the axial direction, of the developing part that is provided opposite a toner image carrier of the toner-image forming part and develops a toner image on the toner image carrier is larger than the contact width, in the axial direction, between the second transfer part and the intermediate transfer body.

4. An image forming apparatus comprising:

a toner-image forming part that forms a toner image;

a first transfer part that transfers the toner image formed by the toner-image forming part to an intermediate transfer body;

a second transfer part that contacts a back surface of a recording medium to transfer the toner image on the intermediate transfer body to the recording medium;

a paper feed part that is provided on the upstream side of the second transfer part and feeds the recording medium to the second transfer part;

a fixing part including a fixing member that is heated to fix the toner image to the recording medium and a pressure member that transports the recording medium in cooperation with the fixing member by pinching the recording medium therebetween;

an output part that is disposed on the downstream side of the fixing part and outputs the recording medium having the toner image fixed thereto by the fixing part, and a recording medium transport device extending vertically between the output part and the paper feed part, wherein the contact width, in the axial direction, between the second transfer part and the intermediate transfer body is larger than the contact width, in the axial direction, between the pressure member and the fixing member, and wherein the width of the second transfer part is smaller than the width of the fixing member.

* * * * *